US005730613A

United States Patent [19]

Yamada

[11] Patent Number: 5,730,613

[45] Date of Patent: Mar. 24, 1998

[54] ELECTRICAL CONNECTOR FOR CONNECTING FLEXIBLE CIRCUIT BOARDS

[75] Inventor: Masahiro Yamada, Sagamihara, Japan

[73] Assignee: Berg Technology, Inc., Reno, Nev.

[21] Appl. No.: 553,349

[22] PCT Filed: May 20, 1994

[86] PCT No.: PCT/US94/05761

§ 371 Date: Feb. 12, 1996

§ 102(e) Date: Feb. 12, 1996

[87] PCT Pub. No.: WO94/28599

PCT Pub. Date: Dec. 8, 1994

[30] Foreign Application Priority Data

May 20, 1993 [JP] Japan ..... 5-026278

[51] Int. Cl.[6] ..... H01R 13/28

[52] U.S. Cl. ..... 439/293

[58] Field of Search ..... 439/284, 290, 439/291, 293, 295, 292, 631, 533, 527, 491, 492, 493, 494, 495, 496, 497, 498, 499

[56] References Cited

FOREIGN PATENT DOCUMENTS 0 540 260 A2 5/1993 European Pat. Off. .

OTHER PUBLICATIONS

Patent Abstracts of Japan, vol. 15, No. 390, (E–1118), Oct. 3, 1991 & JP–A–03 156872 (Oki Densen KK), Jul. 4, 1991.

*Primary Examiner*—P. Austin Bradley

*Assistant Examiner*—Barry M. L. Standig

*Attorney, Agent, or Firm*—Woodcock Washburn Kurtz Mackiewicz & Norris LLP

[57] ABSTRACT

An electrical connector which may be used as a male or female type of connector for connecting to a flexible board and another identical connector. A plurality of contacts is located in a housing of the connector and each contact has a substantially "h" shape. One end of each contact has a pair of first contact projections for clamping the flexible board. The other end has a second contact projection, which extends along a wall of the housing of the connector. As the wall of the connector is fit into a slot of another connector, the second contact projection of each contact of the connector presses the first contact projections of each corresponding contact of the other connector, urging the clamping of the board by the first contact projections.

21 Claims, 5 Drawing Sheets

ELECTRICAL CONNECTOR FOR CONNECTING FLEXIBLE CIRCUIT BOARDS

BACKGROUND OF THE INVENTION

1. Field of the Invention

The present invention relates to an electrical connector for electrically connecting a first flexible board and an other identical connector, and more specifically, to a electrical connector which may be used as a male or a female type of connector.

2. Description of Related Art

In order to mutually connect two flexible printed circuit boards to each other in the casing of an electrical apparatus (for example, video tape recorder), generally, a male connector and a female connector, each connected to the respective flexible circuit boards, are used. When the male and female connectors are coupled together, the two flexible circuit boards are then electrically connected.

The male and female connectors each has a housing including a plurality of contacts. The shape of the housing varies in accordance with the type of the connector, i.e., male or female, so as to make it fit with the housing of another connector.

Each of the contacts in the housing of a connector has a first contact point to be brought into contact with one of the flexible circuit boards and a second contact point to be brought into contact with the other connector. The shape of the second contact point varies in accordance with the type of the connector.

Therefore, in order to manufacture male and female connectors, two types of housing casting molds and two types of contact punching-out dies are necessary, i.e., one each for the male and the female connectors.

SUMMARY OF THE INVENTION

In order to decrease the production cost of connectors, it is preferable to design housings and contacts that have the same shape for both male and female connectors.

The object of the invention is to provide a connector that may be used as either a male or female type of connector since the connector is identical for both types. Accordingly, the production cost of the connectors can be decreased.

In order to achieve the above and other objects, there is provided, according to the present invention, electrical connectors which can be connected to each of first and second flexible boards so as to electrically connect the boards to each other. An electrical connector includes a housing having a first surface including an opening for receiving the first flexible board, and a second surface including a projecting portion and a recess portion, the opening and the recess portion communicating with each other, and the projecting portion and the recess portion formed in shapes so that the projecting portion of the housing of the connector fits into the recess portion of the housing of the other identical connector.

The electrical connector also includes a plurality of elastic contacts situated in the housing and having an identical shape, for establishing an electrical connection to a flexible substrate of the first flexible board, each of the contacts having a first contact portion located at the opening of the housing for clamping to the flexible substrate to provide electrical contact thereto, a second contact portion located at the projecting portion of the housing, and a third contact portion located in the first surface of the housing, the second contact portion configured to engage the third contact portion of the other identical connector when the projecting portion of the connector is fit into the recess portion of the housing of the other identical connector so that the first flexible board is electrically connected to the second flexible board.

According to the connector of the present invention, the protrusion portion of the housing of one connector can be fit into the recess portion of the housing of another connector, and therefore the housing can be used regardless of the connector, i.e., male or female.

In addition, according to the connector of the present invention, the contacts of either type of connector have an identical shape, and therefore, the contacts can be used regardless whether the connector is a male or female type. Further, when the protrusion portion of one connector is fit into the recess portion of another connector of the present invention, the force of the contact which acts to press the flexible board is increased by the elasticity of the contact between the connectors, and therefore a high firmness between the contact and the flexible board can be achieved.

DESCRIPTION OF THE PREFERRED EMBODIMENT

Figure 1:
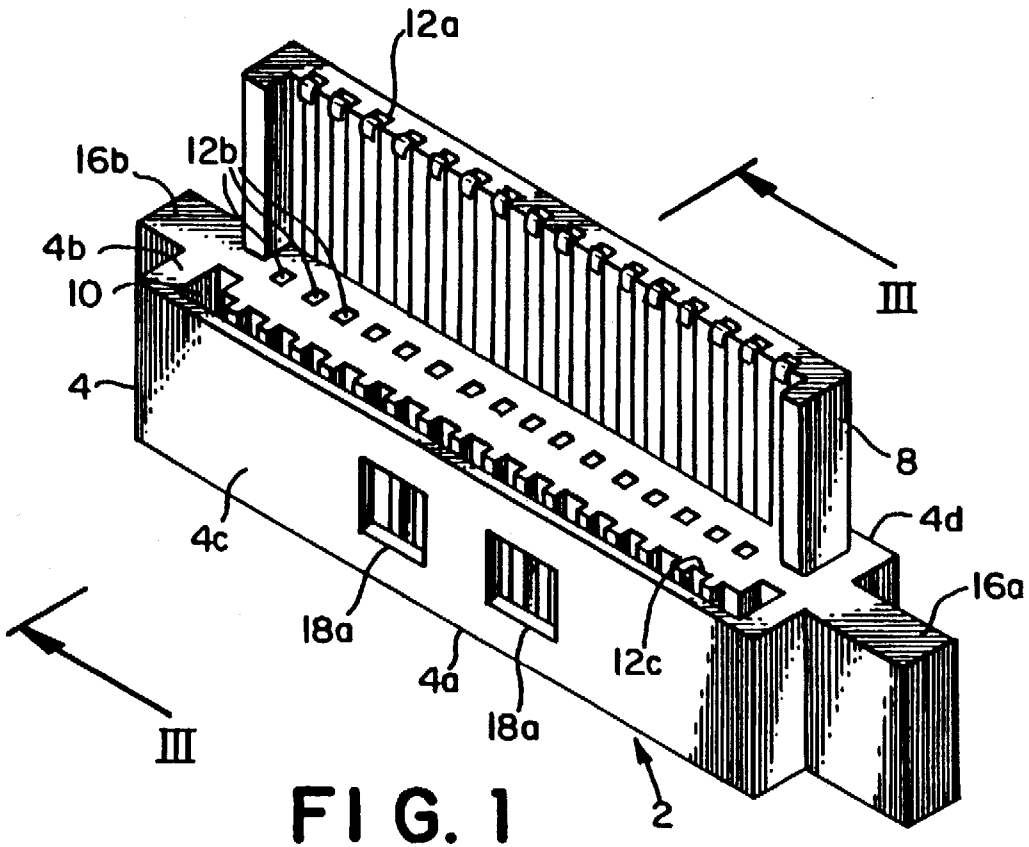
FIG. 1 is a perspective view of an electrical connector according to a first embodiment of the present invention.
Figure 2:
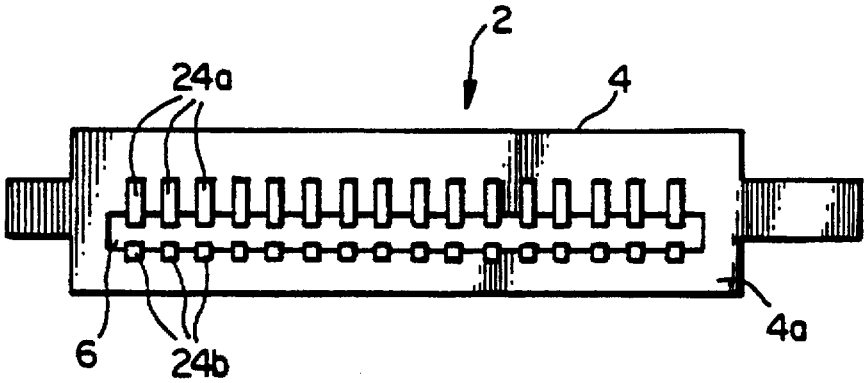
FIG. 2 is a bottom view of the electrical connector shown in FIG. 1 showing the bottom surface.
Figure 3:
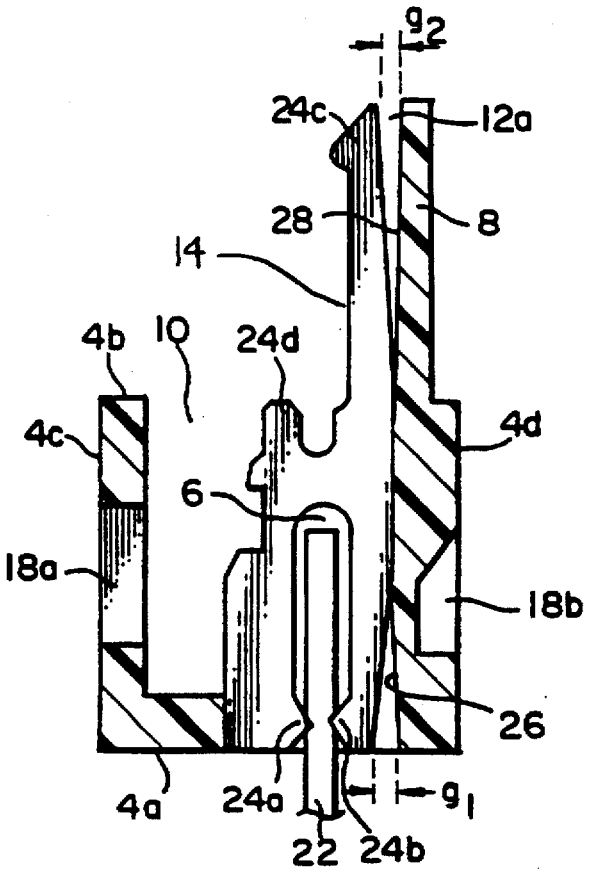
FIG. 3 is a cross section of the electrical connector shown in FIG. 1 taken along the line III—III shown in FIG. 1.

FIGS. 1 to 3 show an electrical connector according to an embodiment of the present invention. A connector 2, which may be used as a male or female connector, is used in pairs of two, each having the same shape, i.e., identical, to form an interconnection. The connector 2 as shown in FIG. 1 has a housing 4 formed by a molding process. A lower surface 4*a* of the housing 4 has a first slot 6 for accepting a flexible printed circuit board.

An upper surface 4*b* of the housing 4 has a wall 8 extending along one of the longitudinal peripheries of the upper surface 4*b* and a second slot 10 extending along the other longitudinal periphery of the upper surface 4*b*. The wall 8 and the second slot 10 each has a vertical cross section of a substantially "U" shape, and they are arranged so as to face each other. The wall 8 and the upper surface 4*b* of the housing 4 have first and second cavities 12*a* and 12*b*, respectively, for receiving a plurality of contacts 14 of the connector 2.

The second slot 10 has a third cavity 12*c* for receiving a plurality of contacts 14 of another connector. It should be noted that the first cavity 12*a* extends upward along the wall 8, the second cavity 12*b* extends from the upper surface 4*b* of the housing towards the inside of the housing 4, and the third cavity 12*c* which is coupled with the second slot 10, extends towards the inside of the housing 4.

It is preferable that connector has ribs 16*a* and 16*b* serving to aid affixing the connector 2 to a casing of an electronic apparatus, the ribs projecting from both ends of the housing 4. Further, it is preferable that the projections of the ribs 16*a* and 16*b* be different in length in order to set and determine polarity of the connector 2.

It is also preferable that longitudinal side surfaces 4*c* and 4*d* of the housing 4 have recess portions 18*a* and 18*b* for fixing the connector 2 to the casing of the electronic apparatus. The polarity of the connector 2 can be set by making the shape of the recess portion 18*a* of the side surface 4*c* of the housing 4, different from that of the recess portion 18*b* of the other side surface 4*d*. For example, in FIG. 3, which is a cross section of the electrical connector shown in FIG. 1 taken along the line III—III shown in FIG. 1, the recess portion 18*a* is made through the side surface 4*c* to slot 10, whereas the recess portion 18*b* of the side surfaces 4*d* does not go through wall 8. As can be seen from FIG. 1, contacts 14 are exposed from the recess portion 18*a* of the side surface 4*c*. However, as will be described later, when two connectors are joined together, the recess portion 18*a* is covered by the wall 8 of the joining connector, thereby avoiding any problems that may be caused by the exposure of the contacts 14.

Figure 4:
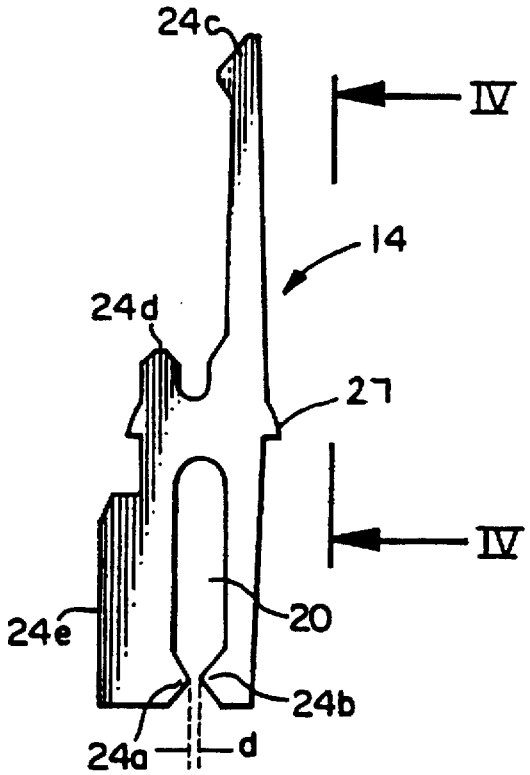
FIG. 4 is a side view of the contact of the electrical connector shown in FIG. 1.
Figure 5:
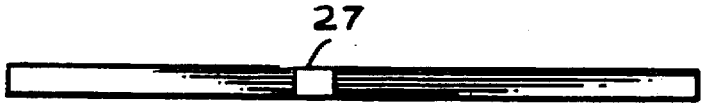
FIG. 5 is a back side view of the contact shown in FIG. 4 showing a back surface of the contact when viewed in a direction designated by arrow IV in FIG. 4.

In the connector 2, the plurality of contacts 14 are arranged at the same interval along the direction of the second slot 10 extending along side surface 4*c*. In an exemplary embodiment of the invention, a contact 14, in particular, such as shown in FIGS. 3 to 5, is made of a plate metal material having a required conductivity and elastic property, such metals include, for example, stamped phosphor bronze, brass and beryllium steel, with the surface plated with gold.

Each of the contacts 14 has substantially an "h" shape. One end of a contact 14 has an opening 20 (as shown in FIG. 4) for holding one end of a flexible printed circuit board 22. The tip end of the opening 20 is limited by contact projections 24*a* and 24*b* which face each other. Each of the contact projections 24*a* and 24*b* formed elastically contact to solder pads (not shown) arranged on each of the surfaces of one end of the circuit board 22. A distance "d" (as shown in FIG. 4) between the contact projections 24*a* and 24*b* facing each other is set slightly smaller than the thickness of the board 22 in an initial state when a board 22 is not inserted into the opening 20.

The contact projection 24*b* of the contact 14 is formed slightly eccentric towards the contact projection 24*a* so as to create a gap "g1" as shown in FIG. 3 between the inner bottom surface 26 of the wall 8 of the housing 4 and itself. Such an arrangement facilitates the accommodation of the board 22 between the contact projections 24*a* and 24*b* facing each other, so that contact 14 may elastically expand when the board 22 is inserted into the opening 20.

The other end of the contact 14 has one contact projection 24*c*. This contact projection 24*c* is also formed eccentric so as to create a gap "g2" between the inner top surface 28 of the wall 8 cavity 12 between the wall 8 and the contact projection 24*c*. A flat shoulder portion 24*d* of the contact 4 is situated between the contact projections 24*a* and 24*c* of the contact 14 such as to be integrated with the upper surface 4*b* of the housing 4. In particular, the contact projection 24*c* and the shoulder portion 24*d* are pushed into the first and second cavities 12*a* and 12*b*, respectively of the housing 4, so as to situate the contact projections 24*a* and 24*b* facing each other in the first slot 6 of the housing 4 in surface 4*a*. The contact as shown in FIG. 4 also has a side protrusion 27 for engaging the inner surface of wall 8 when the contact 14 is placed in the housing 4. The placement of the side protrusion 27 is shown in FIG. 5 where FIG. 5 is a back side view of the contact shown in FIG. 4 showing a back surface of the contact when viewed in a direction designated by arrow IV in FIG. 4.

Figure 6:
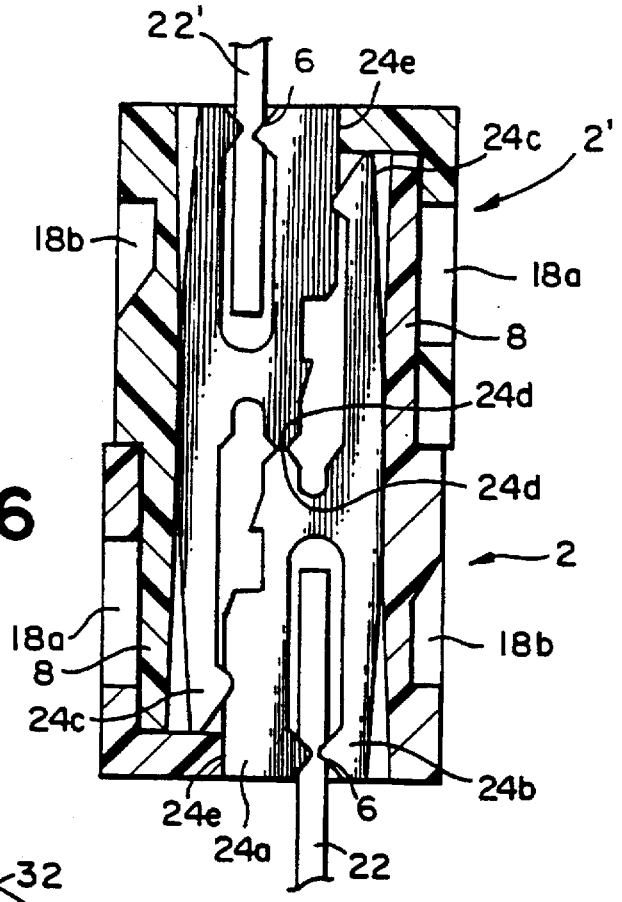
FIG. 6 is a cross section of a second embodiment of the present invention, in which two electrical connectors as shown in FIG. 1 are used to form a board-to-board connection structure.

FIG. 6 depicts a second embodiment of the invention. As shown in this figure, two of the above-described connectors are engaged in series to engage one board 22 to another 22' board. The same structural elements are used in the connector 2' as those in the first embodiment and are designated by the same reference numerals. In this embodiment, the connector designated by reference numerals 2' is identical to the connector 2 of the first embodiment. The flexible printed circuit boards 22 and 22' have a similar thickness and placement of solder pads on substrates on the boards so as to engage projections in the contacts of both the connectors 2 and 2'.

Boards 22 and 22' are inserted to the opening 20 of each contact 14 of the respective connectors 2 and 2' via the first slots 6. The connector 2 is joined to the connector 2' by mutually inserting the wall 8 of one connector to the second slot 10 of the other. Thus, the shoulder portion 24*d* of the each contact 14 of the connector 2 and the shoulder portion 24*d* of each contact 14 of the connector 2' are brought into engagement with each other for electrical connection. At the same time, the contact projection 24*c* of each contact 14 of the connector 2 is inserted into a third cavity 12*c* of the connector 2'.

Since the contact projection 24*c* is formed eccentrically as mentioned above, it is brought into contact with the back surface 24*e* of the contact projection 24*a* of each contact 14 of the connector 2', and elastically pushes the contact projection 24*a* towards the contact projection 24*b*. As a consequence, the solder pads on the substrate of the board 22' are further firmly pressed by the contact projections 24*a* and 24*b* of each contact 14 of the connector 2', thereby assuring the electrical connection between the contacts 14 of the connector 2' and the board 22'. Similarly, the contact projection 24*c* of each contact 14 of the connector 2' elastically presses the contact projection 24*a* of each contact 14 of the connector 2 towards the contact projection 24*b*. Therefore, the contacts 14 of the connector 2 are securely electrically connected to the substrate or solder pads of the board.

As described above, the board 22 is electrically connected to the board 22' by joining the connector 2 to the connector 2'. In part, the force of each contact of each connector to the corresponding board is urged by the interconnection of the connectors. Further, the wall 8 of each connector serves to cover the recess portion 18*a*, of the other connectors, as each connector is inserted into the second slot 10 of the other connector, and therefore the contact point between a contact 14 of the connector and a contact 14 of the connector 2' is completely covered, thereby suppressing the leakage of the electricity.

Figure 7:
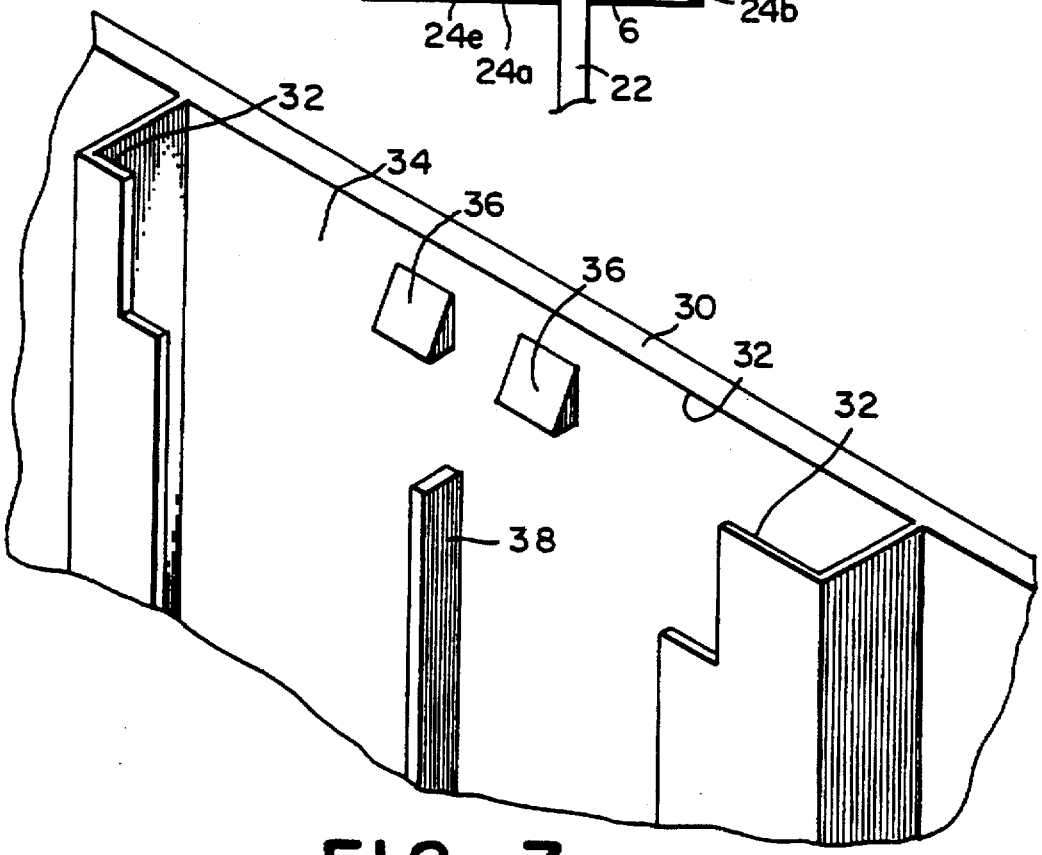
FIG. 7 is a perspective view of a third embodiment of the present invention, showing the structure of a casing to which an electrical connector shown in FIG. 1 is set.
Figure 8:
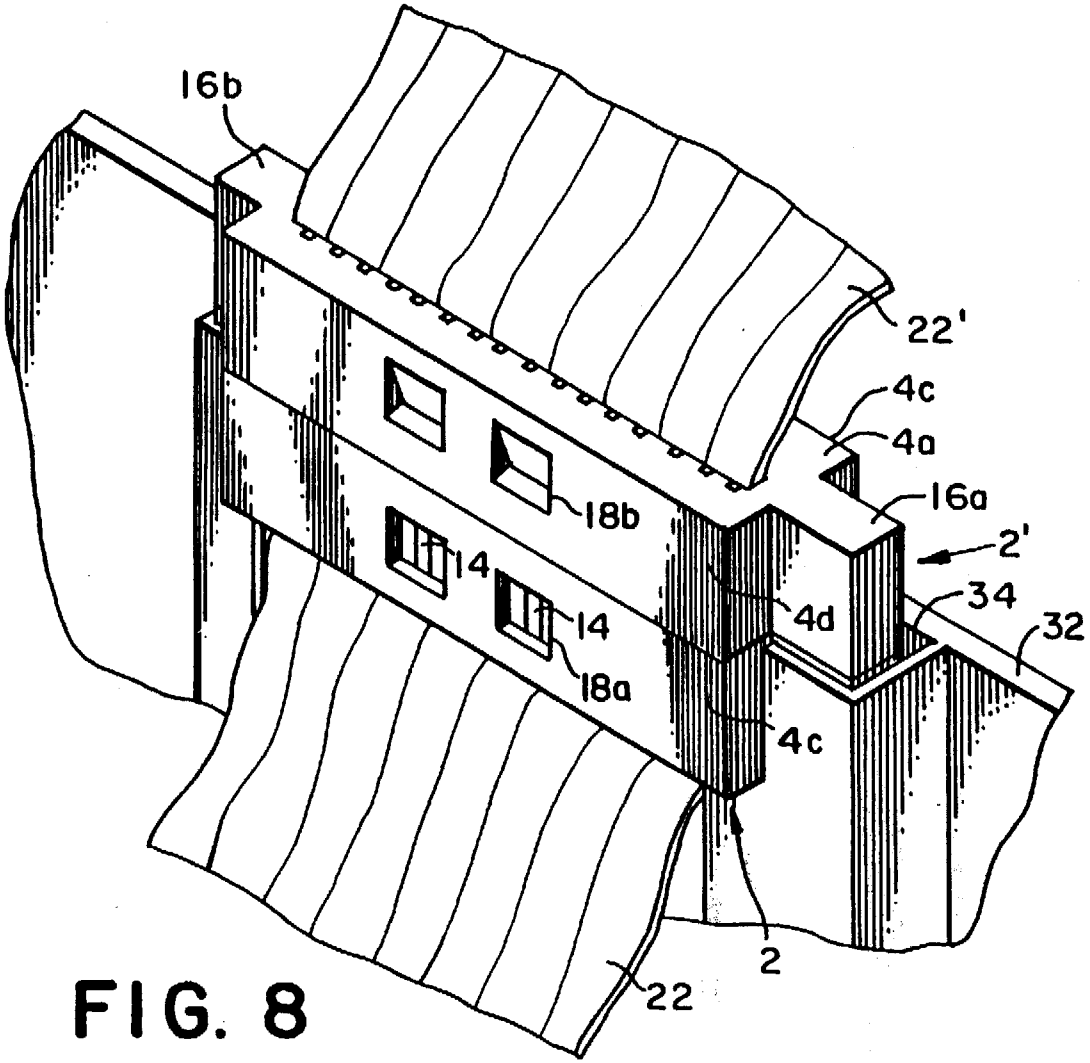
FIG. 8 is a perspective view of the structure of the casing shown in FIG. 7 in a state where two electrical connectors are set.

FIGS. 7 and 8 are diagrams showing a structure of the casing of an electronic apparatus, upon which the connector 2 may be mounted. A portion of an inner wall 32 of the casing 30 forms a pocket 34 which fits the out-line of the lateral cross section of the housing 4 of the connector 2. On the inner wall 32 of the casing, which is located in the pocket 34, projections 36 are formed for matingly engaging the recess portion 18*a* or 18*b* of the housing 4. When the housing 4 is fit into the pocket 34 and the projections 36 are engaged with the recess portions 18*a* or 18*b* of the housing 4, the connector 2 is set in the casing 30. In order to prevent the connector 2 from dropping out of a predetermined mounting position, it is preferable that the inner wall 32 of the casing have a stopper 38 for supporting the connector 2.

As described, there is no distinction between male and female types of housings or contacts in the electrical connector of the present invention. Therefore, the same electrical connector can be used as a socket side or an insert side connector. Consequently, during production of the electrical connector of the present invention, only one type of a mold need be used to produce the housing and only one type of die to produce the contacts, thus achieving a reduction in the production cost of the electrical connectors.

What is claimed is:

1. An electrical connector which can be connected to a first flexible board and to another identical electrical connector where the other electrical connector can be connected to a second flexible board so as to electrically connect the first and second boards to each other, said electrical connector comprising:

a housing having a first surface including an opening for receiving the first flexible board, and a second surface including a projecting portion and a recess portion, the opening and the recess portion communicating with each other, and the projecting portion and the recess portion formed in shapes so that the projecting portion of the housing of the connector fits into the recess portion of the housing of the other identical connector; and a plurality of elastic contacts situated in the housing and having an identical shape, for establishing an electrical connection to a flexible substrate of the first flexible board, each of the contacts having a first contact portion located at the opening of the housing for clamping to the flexible substrate to provide electrical contact thereto, a second contact portion located at the projecting portion of the housing, and a third contact portion located in the first surface of the housing, the second contact portion configured to engage the third contact portion of the other identical connector when the projecting portion of the connector is fit into the recess portion of the housing of the other identical connector so that the first flexible board is electrically connected to the second flexible board.

2. An electrical connector according to claim 1, wherein said contacts are configured so that the second contact portion of each contact of the connector presses the first contact portion of each corresponding contact of the other identical connector and the second contact portion of each contact of the other identical connector presses the first contact portion of each corresponding contact of the connector, thereby elastically compressing the first contact portions of the contacts of the connector to clamp the first flexible board and elastically compressing the first contact portions of the contacts of the other identical connector to clamp the second flexible board.

3. An electrical connector according to claim 1, wherein said housing has a rib projecting from each end of the housing, the ribs serving to aid affixing the connector to a casing of an electronic apparatus.

4. An electrical connector according to claim 3, wherein the projections of the ribs of the housing of the connector are different in length.

5. An electrical connector according to claim 1, wherein said housing has longitudinal side surfaces and said longitudinal side surfaces have recess portions for fixing the connector to a casing of an electronic apparatus.

6. An electrical connector according to claim 5, wherein the shape of the recess portion on one longitudinal side surface of the housing is different from that of the recess portion of the other longitudinal side surface of the housing.

7. An electrical connector according to claim 6, wherein the recess portion on the longitudinal side surface opposite the projecting portion is made through the side surface to communicate with the recess and the recess portion on the other longitudinal side surfaces does not go through the side surface.

8. An electrical connector according to claim 7, wherein the recess portion on the longitudinal side surface opposite the projecting portion is covered by the projecting portion of the other identical connector when the projecting portion of the other identical connector is fit into the recess portion of the housing of the connector.

9. An electrical connector according to claim 2, wherein said contacts are substantially "h" shaped.

10. An electrical connector according to claim 9, wherein the contacts are made of a plate metal selected from the group consisting of phosphor bronze, brass and beryllium steel.

11. An electrical connector according to claim 10, wherein surfaces of the contacts are plated with gold.

12. An electrical connector according to claim 9, wherein the first contact portion has an opening for holding one end of a flexible board.

13. An electrical connector according to claim 12, wherein a tip end of the opening of the first contact portion is limited by contact projections which face each other.

14. An electrical connector according to claim 13, wherein the distance between the contact projections facing each other is set smaller than the thickness of the flexible board when the flexible board is not inserted into the opening.

15. An electrical connector according to claim 13, wherein the contact projection of the first contact portion closest to the projecting portion of the housing is formed eccentric towards the contact projection so as to create a gap between an inner bottom surface of a wall of the projecting portion of the housing and itself.

16. An electrical connector according to claim 1, wherein the second contact portion of the contact is formed eccentric towards the end of the second contact portion so as to create a gap between an inner top surface of a wall of the projecting portion of the housing and itself.

17. An electrical connector according to claim 1, wherein the projecting portion of the connector is fit into the recess portion of the housing of the other identical connector and the projecting portion of the other identical connector is fit into the recess portion of the housing of the identical connector so that the first flexible board is electrically connected to the second flexible board.

18. An electrical connector according to claim 1, wherein the connector is mounted in a casing of an electronic apparatus.

19. An electrical connector according to claim 18, wherein a portion of an inner wall of the casing forms a pocket which fits an outline of a lateral cross section of the housing of the connector.

20. An electrical connector according to claim 19, wherein projections are formed on the inner wall of the casing located in the pocket of the casing for matingly engaging a recess portion of the housing of the connector.

21. An electrical connector according to claim 20, wherein the inner wall of the casing includes a stopper for supporting the housing of the connector.

* * * * *